US005778455A

United States Patent [19]

Joseph

[11] Patent Number: 5,778,455

[45] Date of Patent: Jul. 14, 1998

[54] EAR COVER

[76] Inventor: Dephillia M. Joseph, 1319 Omar St., Houston, Tex. 77008

[21] Appl. No.: 842,672

[22] Filed: Apr. 15, 1997

[51] Int. Cl.[6] ..... A42B 1/06

[52] U.S. Cl. ..... 2/209; 2/174

[58] Field of Search ..... 2/174, 275, 209, 2/50, 49.1, 53, 273.1; 602/74, 76

[56] References Cited

U.S. PATENT DOCUMENTS

| | | | |
|---|---|---|---|
| 797,434 | 8/1905 | Homeyer | 2/49.4 |
| 2,378,398 | 6/1945 | Fiedler . | |
| 2,582,907 | 1/1952 | Kaufmann . | |
| 3,112,493 | 12/1963 | Greenberg . | |
| 3,303,514 | 2/1967 | Wessels | 2/174 |
| 3,525,103 | 8/1970 | Yonan | 2/174 |
| 4,134,153 | 1/1979 | Voorhees | 2/174 |
| 4,308,623 | 1/1982 | Voorhees | 2/174 |
| 4,616,643 | 10/1986 | Jung | 2/174 |
| 4,660,229 | 4/1987 | Harris | 2/174 |
| 4,665,567 | 5/1987 | Dilger | 2/174 |
| 4,791,684 | 12/1988 | Schwartz . | |
| 4,872,219 | 10/1989 | Duncan . | |
| 4,935,965 | 6/1990 | Wassell | 2/209 |
| 5,339,467 | 8/1994 | Brinkley . | |

*Primary Examiner*—Gloria M. Hale
*Attorney, Agent, or Firm*—Stephen R. Greiner

[57] ABSTRACT

An ear cover for protecting the external ear of a wearer. The cover includes a first flexible sheet having an outer layer formed of an absorbent material and an inner layer coextensive therewith formed of an impermeable material. A second flexible sheet is secured to the first flexible sheet adjacent the inner layer to serve as a liner for the cover. An elastic band is secured between the first and second flexible sheets for gathering the respective peripheries thereof around the ear of a wearer.

12 Claims, 2 Drawing Sheets

FIG. 2
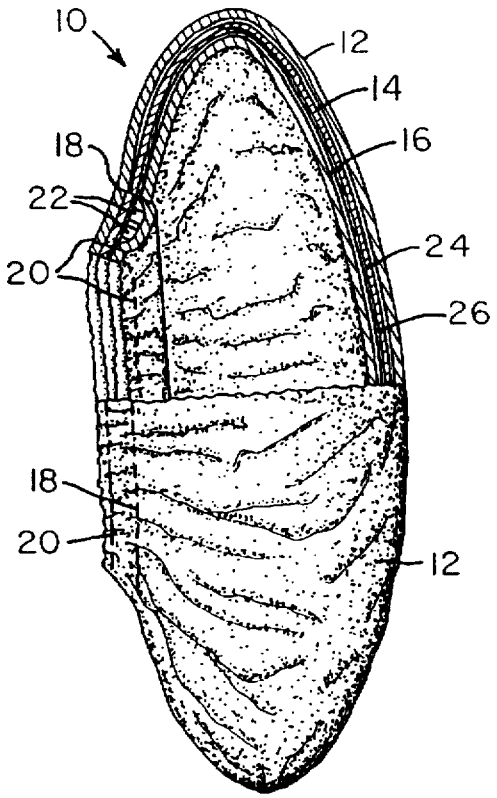
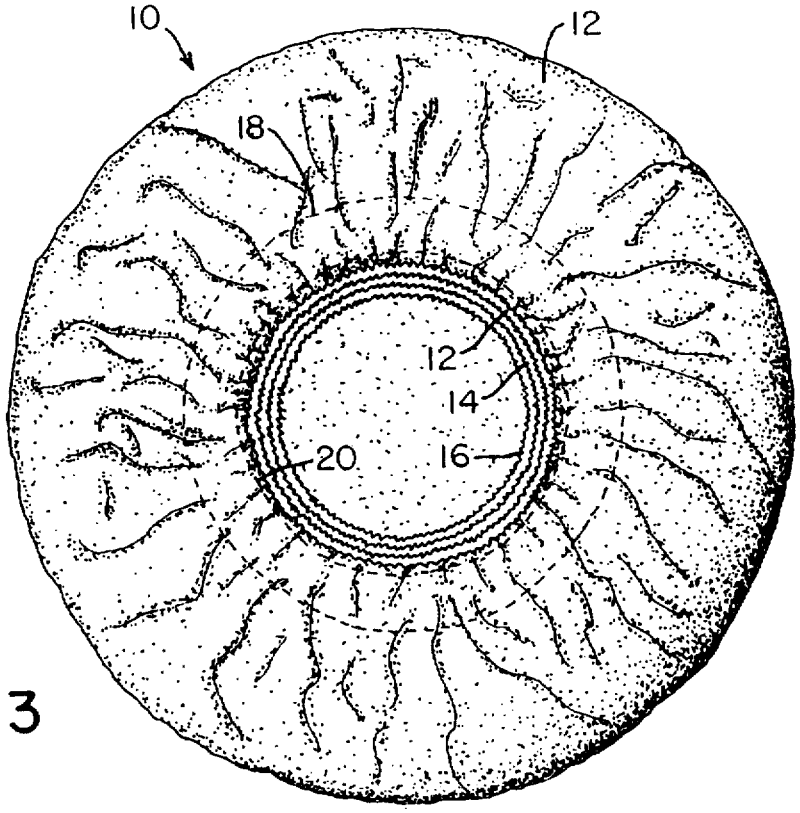
FIG. 3

EAR COVER

FIELD OF THE INVENTION

The present invention relates generally to head coverings and, in particular, to ear protectors and muffs.

BACKGROUND OF THE INVENTION

From time to time, many individuals apply liquid chemical compositions to the hair growing from their heads in an effort to establish a "permanent" or long-lasting hair setting. While these chemical compositions are usually effective in holding treated hair in a chosen style, they are often caustic and can cause burns when applied to the skin. The external ears, being exposed on the head, are particularly vulnerable to such burns. A need, therefore, exists for a cover that may be applied to the ear in order to prevent chemical burns during hair treatments.

SUMMARY OF THE INVENTION

In light of the above-mentioned problem, it is the principal object of the present invention to provide a cover for the external ear of a wearer which can absorb liquid chemical compositions like hair setting solutions, relaxants and dyes to prevent such from contacting the ear. Similarly, the cover will prevent incidental contact between heat sources, like curling irons and blow dryers, and the ear.

It is an additional object of the invention to provide an ear cover of the type described which may be positioned upon the external ear of any user in a comfortable and secure manner.

It is an object of the invention to provide improved elements and arrangements thereof in an ear cover for the purposes described which is lightweight in construction, inexpensive in manufacture, and fully effective in use.

Briefly, the ear cover in accordance with this invention achieves the intended objects by featuring a first flexible sheet having an absorbent layer and an impermeable layer coextensive therewith. A second flexible sheet is secured to the first flexible sheet adjacent the impermeable layer. An elastic band is secured between the first and second sheets for gathering the peripheries thereof around the ear of a wearer. An optional, third flexible sheet, formed of an absorbent material, may be secured to the first sheet adjacent its absorbent layer to enhance the ability of the cover to absorb liquids.

The foregoing and other objects, features and advantages of the present invention will become readily apparent upon further review of the following detailed description of the preferred embodiment as illustrated in the accompanying drawings.

BRIEF DESCRIPTION OF THE DRAWINGS

The present invention may be more readily described with reference to the accompanying drawings, in which:

FIG. 2 is a side elevational view of the ear cover having portions broken away to reveal the interior details thereof.

FIG. 3 is a front elevational view of the ear cover.

Similar reference characters denote corresponding features consistently throughout the accompanying drawings.

DETAILED DESCRIPTION OF THE PREFERRED EMBODIMENT

Figure 1:
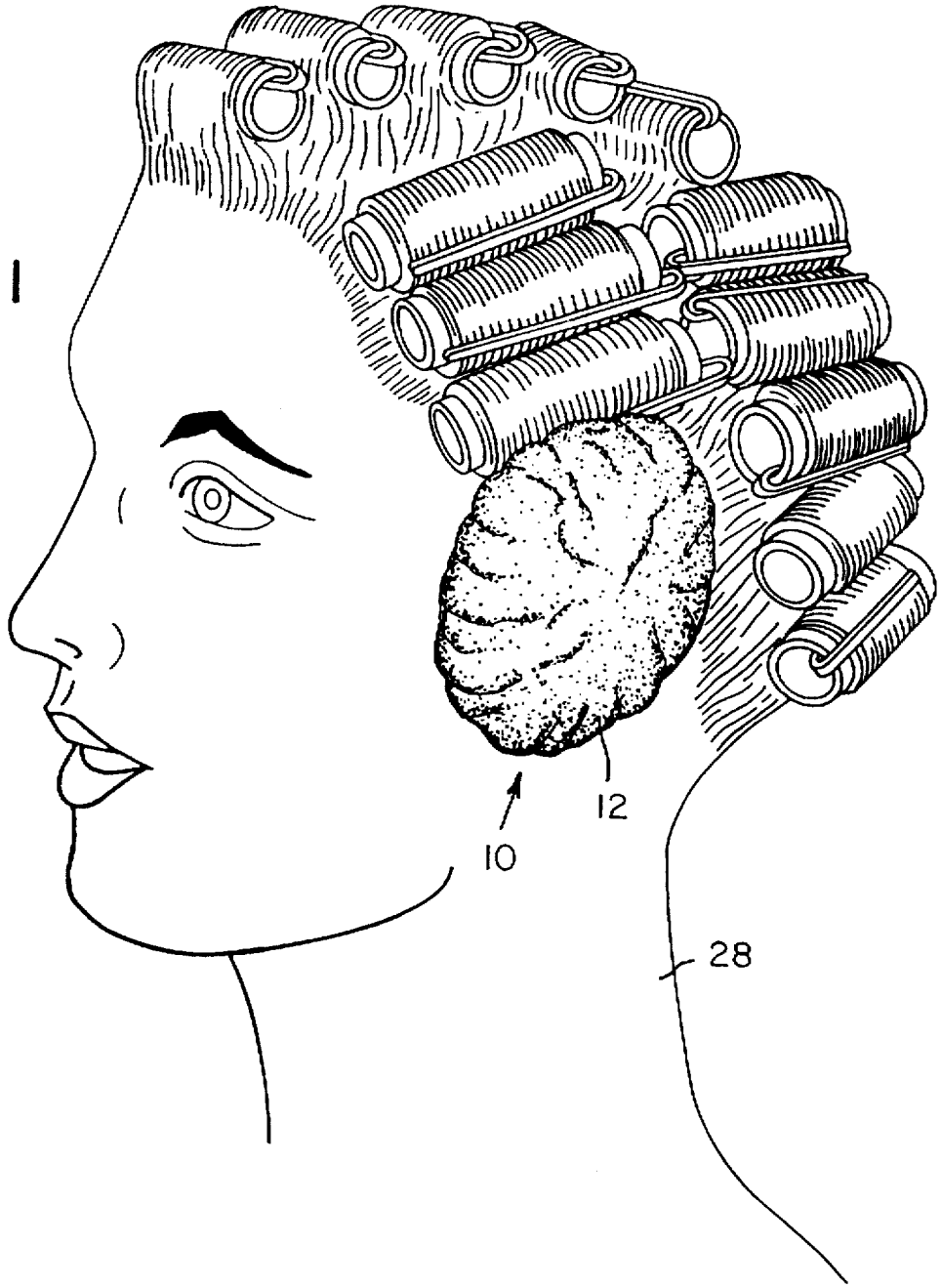
FIG. 1 is a perspective view of an ear cover in accordance with the present invention shown positioned upon the ear of a user.

Referring now to the FIGS., an ear cover in accordance with the present invention is shown at 10. The ear cover 10 includes three flexible sheets or disks 12, 14 and 16 each having a diameter of about 5.75 inches (14.6 cm) which are secured side-by-side by a pair of sewn peripheral seams 18 and 20. Secured between the median disk 14 and the inner disk 16 by the seams 18 and 20 is an elastic band 22 for gathering the peripheral edge of the cover 10 so that it may be snugly fastened about the ear of a user.

The flexible disks 12, 14 and 16 comprise unconventional materials. The outer disk 12 and the inner disk 16 are preferably cut from sheets of liquid-absorbent paper. The median disk 14, however, is preferably cut from a sheet of machine-quilted "flat wrap" material manufactured by Scott Paper Company of Wilmington, Del. Thus, the median disk 14 includes a relatively thin, absorbent, paper layer 24 and an impermeable, plastic film 26 affixed to one side thereof. As shown, the plastic film 26 of the median disk 14 is positioned adjacent the inner disk 16.

Preferably, the elastic band 22 comprises a conventional rubber band having a relaxed diameter of about 2.7 inches (6.9 cm). When inserted between the disks 14 and 16, the band 22 is doubled back upon itself so that two strips of rubber extend substantially around the periphery of the cover 10. The doubled configuration of the band 22 increases the force with which it can radially press against the base of the ear during use.

The band 22 may be secured to the periphery of the cover 10 in any desired manner. Preferably, the disks 12, 14 and 16 are first stitched together by the application of peripheral seam 18 thereto. One portion of the band 22 is next positioned between the disks 14 and 16 and is firmly held or stitched in place against the seam 18. While moving the remainder of the band 22 around the seam 18, the peripheral seam 20 is sewn through the disks 12, 14 and 16. When the band 22 is wrapped fully around the seam 18, its adjacent ends are sewn together or to the disks 12, 14 and 16. The seam 20 is then completed to secure the band 22 within the cover 10. After sewing, the seams 18 and 20 may be treated with a chemical sealant if desired.

The finished cover 10 may be easily positioned upon the ear of a user 28, as shown in FIG. 1, by stretching the band 22 over the external ear and allowing it to contract around the base of the ear. With the inner disk 16 positioned against the ear for comfort and to absorb perspiration, the outer disk 12 and absorbent layer 24 of the median disk 14 are positioned to absorb wayward chemical compositions such as: hair setting solutions, relaxants and dyes. The plastic film 26 of the median disk 14 prevents any chemical compositions absorbed by the outer disk 12 and layer 24 of the median disk from contacting and burning the covered ear. After use, the cover 10 may be removed from the ear and gently washed for reuse or discarded as desired.

While the inventive cover has been described with a high degree of particularity, it will be appreciated by those skilled in the art that many modifications may be made thereto. For example, the outer disk 12, which serves largely as a protective cap for the median disk 14, may be omitted in "economy" versions of the cover. Further, the disks 12, 14 and 16 may be provided with other geometrical shapes, like those of an oval, to accommodate ears and the like with a more precise fit and tailored appearance. Therefore, it is to be understood that the present invention is not limited to the sole embodiment described above, but encompasses any and all embodiments within the scope of the following claims.

I claim:

1. A cover for the external ear of a human, comprising:

a first flexible sheet having an outer layer formed of an absorbent material and an inner layer coextensive therewith formed of an impermeable material;

a second flexible sheet secured to said first flexible sheet adjacent said inner layer; and, an elastic band secured between said first and second flexible sheets for gathering the respective peripheries thereof.

2. The ear cover according to claim 1 wherein the outer layer of said first flexible sheet comprises absorbent paper.

3. The ear cover according to claim 2 wherein the inner layer of said first flexible sheet comprises a plastic film.

4. The ear cover according to claim 1 wherein the second flexible sheet comprises absorbent paper.

5. The ear cover according to claim 1 further comprising a third flexible sheet covering said first flexible sheet adjacent said outer layer.

6. The ear cover according to claim 5 wherein said third flexible sheet comprises absorbent paper.

7. An external ear cover, comprising:

a first flexible sheet sized to enclose the external ear of a wearer, said first flexible sheet having an outer layer formed of absorbent paper and an inner layer coextensive therewith formed of a plastic film;

a second flexible sheet secured to said first flexible sheet adjacent said inner layer, said second flexible sheet being formed of absorbent paper and being coextensive with the inner layer of said first flexible sheet; and, an elastic band secured between said first and second flexible sheets for gathering the respective peripheries thereof.

8. The ear cover according to claim 7 wherein said first flexible sheet has a circular shape.

9. The ear cover according to claim 7 wherein a pair of spaced-apart, sewn seams secure said elastic band between said first and second flexible sheets.

10. The ear cover according to claim 7 further comprising a third flexible sheet secured to said first flexible sheet adjacent said outer layer, said second flexible sheet being formed of absorbent paper and being coextensive with the outer layer of said first flexible sheet.

11. An ear cover, comprising:

a first flexible disk sized to enclose the external ear of a wearer, said first flexible disk having an outer layer formed of absorbent paper and an inner layer coextensive therewith formed of a plastic film;

a second flexible disk secured to said first flexible disk adjacent said inner layer, said second flexible disk being formed of absorbent paper and being coextensive with the inner layer of said first flexible disk;

a third flexible disk secured to said first flexible disk adjacent said outer layer, said second flexible disk being formed of absorbent paper and being coextensive with the outer layer of said first flexible disk; and, an elastic band secured between said first and third flexible disks for gathering the respective peripheries thereof.

12. The ear cover according to claim 11 wherein a pair of spaced-apart, sewn seams secure said elastic band between said first and third flexible disks.

* * * * *